United States Patent [19]

Coja et al.

[11] 3,976,092

[45] Aug. 24, 1976

[54] APPARATUS FOR THE DISTRIBUTION OF CONCRETE

[75] Inventors: Joachim Coja, Gelsenkirchen; Karl-Ernest von Eckardstein, Kamen; Bernhard Meinken, Haltern, all of Germany

[73] Assignee: Friedrich Wilhelm Schwing GmbH, Wanne-Eichel, Germany

[22] Filed: Mar. 19, 1975

[21] Appl. No.: 559,834

[30] Foreign Application Priority Data

July 6, 1974 Germany ..... 2432581

[52] U.S. Cl. ..... 137/343; 137/615

[51] Int. Cl.[2] ..... B67D 5/36; B67D 5/60; B67D 5/64

[58] Field of Search ..... 137/343, 344, 615; 210/520

[56] References Cited

UNITED STATES PATENTS

| | | | |
|---|---|---|---|
| 2,263,168 | 11/1941 | Dorr et al. | 210/520 |
| 3,047,016 | 7/1962 | Andresen | 137/615 |
| 3,114,392 | 12/1963 | Harper | 137/343 X |
| 3,459,222 | 8/1969 | McElroy | 137/615 |
| 3,572,380 | 3/1971 | Jackson et al. | 137/615 X |
| 3,685,543 | 8/1972 | Schwing et al. | 137/615 |
| 3,707,990 | 1/1973 | Schaible et al. | 137/615 |

*Primary Examiner*—Henry T. Klinksiek
*Attorney, Agent, or Firm*—Malcolm W. Fraser

[57] ABSTRACT

Apparatus for distributing concrete comprises a jib rotatably mounted on a tower, with a conveyor pipe line mounted on the end thereof so as to be movable about horizontal and vertical axes. The pipe line is formed in several sections which are connected one below the other by pivotal joints with horizontal axes.

3 Claims, 2 Drawing Figures

APPARATUS FOR THE DISTRIBUTION OF CONCRETE

Figure 1:
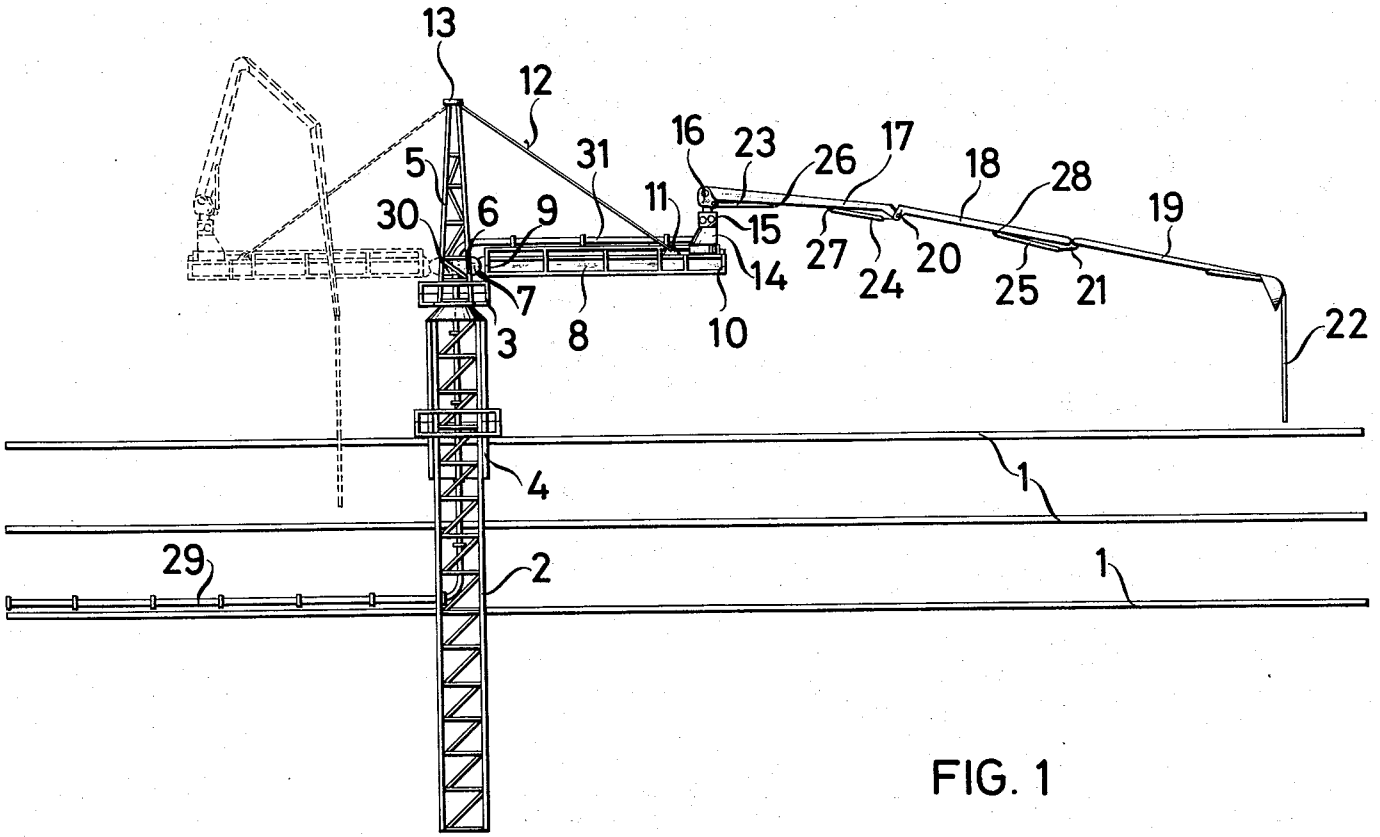

This invention relates to an apparatus for distributing concrete having at least one concrete conveyor pipe line comprising several sections, which are connected one below the other by pivotal joints with horizontal axes, and a support, which is set on a mounting so as to be rotatable about a vertical axis, to which the concrete conveyor pipe line is attached in such a manner as to be able to pivot about a horizontal axis. That section of the pipe conducting the concrete which is located between the support and the end pipe is referred to as a concrete conveyor pipe line.

Such an apparatus is known. The mounting is set on a tubular support erected on a construction site. From such an apparatus it is required that the concrete conveyor pipe line should have as large a working range as possible. For this purpose, the concrete conveyor pipe line has, for example, two or three sections, which can be folded together so that the end of the concrete conveyor pipe line can reach the whole area between the tubular support and a circular path swept by the end of the extended concrete conveyor pipe line. In known apparatus the concrete conveyor pipe line is between 30 and 40m. long. Indeed in very large construction sites, for example, in the production of concrete drilling platforms this length is not sufficient for covering the whole surface of the construction site. Extension of the concrete conveyor pipe line by the attachment of further sections is uneconomical because of the high cost of the pivotal joints. Then difficulties also arise in controlling and operating the apparatus because each section must be controlled individually.

Increasing the length of the sections is also not feasible because cranes are also installed on the construction site near the apparatus for distributing concrete, the maximum height of the jibs of which is limited. The height of the apparatus with a folding concrete conveyor pipe line must be smaller than that of the jibs of the cranes situated on the construction site.

It is the object of the invention to widen the working area in an apparatus for distributing concrete having folding sections without increasing the the number of pivotal joints or sections and without increasing the height of the apparatus.

Solution of this objection consists of locating the mounting at the end of a jib which is mounted on a tower so as to be pivotable about a vertical axis.

In this apparatus the range of the concrete conveyor pipe line is increased almost by the entire length of the jib. The working area is enlarged accordingly. Because of the low number of sections, simple controls can be used which are easy to operate.

If the area underneath the support is being concreted the height of the apparatus remains limited so that the working of cranes installed on the construction site is not obstructed. With the apparatus, concreting can also take place near the tower, because the concrete conveyor pipe line can be pivoted backwards on the joint situated on the support so that the end of the concrete conveyor pipe line can also encompass the area covered by the jib. This is, of course, provided that the jib is not longer than the concrete conveyor pipe line. The maximum working area is thus achieved if jib and concrete conveyor pipe line are of the same length.

The concrete conveyor pipe line and the tower can be mass-produced units, which are assembled on the construction site according to the practical requirements. For example, the tower of a crane can be used as the tower while not being used for other purposes. When the concreting work is over, the units can be separated again and employed elsewhere.

A tower can be used which is designed for smaller load moments than corresponds to the load moments of jib and concrete conveyor pipe line. The apparatus facilitates a more favourable equilibrium of moments, because the load moment of the jib together with the load moment of the concrete conveyor pipe line, when the sections thereof are folded in a vertical position, can be completely compensated, so that the tower only needs to accommodate the additional load moments arising when the concrete conveyor pipe line is extended or is pivoted backwards across the jib.

In order to increase the capacity of the apparatus two jibs, which can be pivoted simultaneously on an axis, can be provided lying opposite one another in relation to the axis so as to be counterbalanced.

It is useful if the axis of rotation of the jib or jibs coincides with the central vertical axis of the tower because then the stress moment is at its lowest under all loads.

Furthermore, each jib may consist of one pipe. Pipes have the most favourable form for torsional stresses around the longitudinal axis of the jib, which arise if the concrete conveyor pipe line is not in alignment with the longitudinal axis of the jib during the distribution of concrete. Thus the weight of the jib or jibs can be kept low.

Finally, the jib or jibs may also have a climbing device, so that the apparatus may be adjusted as construction progresses.

Figure 2:
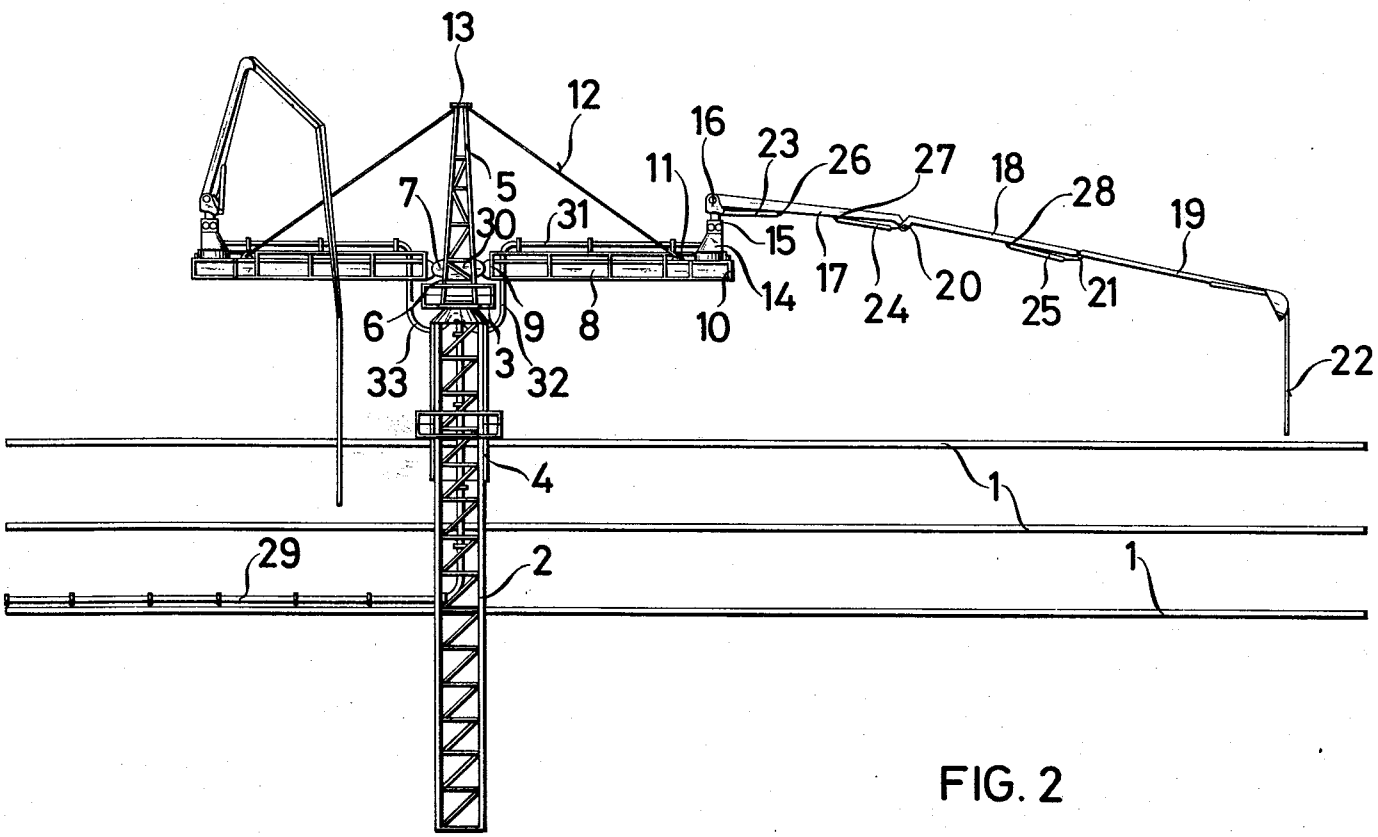

The invention will be further described below with reference to the embodiment shown in the drawings;

FIG. 1 shows the view of an apparatus for distributing concrete with a concrete conveyor pipe line, FIG. 2 shows an apparatus with two concrete conveyor pipe lines.

The apparatus shown in FIG. 1 has a perpendicular crane tower 2 anchored within a construction site 1. At the upper end of the tower 2 is located a rotation track ring 3, which can be raised as construction progresses by means of a climbing device 4. The track ring 3 carries a mast 5, on the lower end 6 of which is arranged a joint 7 with a horizontal axis, to which a jib 8 is attached with its end 9. On the other end 10 of the jib 8 a span cable 12 is mounted at 11, said cable being fixed to the tip 13 of the mast. The jib 8 is so held by the span cable 12 that its central longitudinal axis is situated in a horizontal plane.

The jib 8 consists of a pipe and carries a mounting 14 on its end 10, on which mounting a support 15 is set for angular movement about a vertical axis. The support 15 has a pivotal joint 16 on its upper end with a horizontal axis, to which a concrete conveyor pipe line is attached. The concrete conveyor pipe line consists of three sections 17, 18, 19, which are connected one after another by pivotal joints 20, 21 with horizontal axes. The concrete conveyor pipe line ends in a flexible pipe 22.

Hydraulic rams 23, 24 and 25 facilitate pivoting of the sections 17, 18 and 19 around the respective horizontal axes of the joints 16, 20 and 21. Ram 23 is pivotally attached to the support 15 and, at 26, to section 17.

Ram 24 is pivotally attached at 27 to section 17 as well as to pivotal joint 20. Ram 25 is pivotally attached at 28 to section 18 as well as to pivotal joint 21. Rams 23–25 and a drive mechanism located in the support 15 are operated by remote control.

Concrete is forced into the concrete conveyor pipe line from a concrete pump (not shown) via a pipe 29, which is passed vertically up the tower 2 and is attached to a pipe 31 arranged on the jib 8 by means of a cylindrical swivel connection 30. By pivoting the sections 17–19 in relation to one another and by rotating the support 15 the pipe 22 can be moved over the whole area between the tower 2 and the position of the pipe 22 shown in FIG. 1. On the left-hand side of FIG. 1 the jib 8 is shown in broken lines, how the area underneath it is concreted. For this purpose the support 15 is turned so far and the sections 17–19 are so pivoted that the pipe 22 is situated between the end 10 of the jib 8 and the tower 2. In addition the jib 8 can be pivoted on the track ring 3.

The jib 8 has a counterweight (not shown) which counterbalances the load moment of the jib 8 and the concrete conveyor pipe line when the folding sections 17–19 are located in a vertical position. The tower therefore only needs to accommodate the additional positive and negative load moments due to movement of the folding sections 17–19.

In the apparatus according to FIG. 2 the same reference symbols equal the same members. This apparatus is basically identical to the apparatus according to FIG. 1 except that two jibs are provided each of which carries a concrete conveyor pipe line. Both jibs are pivotable simultaneously on an axis and are arranged opposite one another in relation to this axis, so that they counterbalance one another. The concrete conveyor pipe lines of both jibs are each supplied independently by a pipe 29, and are attached to the respective pipes 31 by means of flexible pipes 32, 33. The use of flexible pipes 32, 33 is possible because in the apparatus shown, the jibs only need to be pivoted by 180° on their common axis of rotation, to completely cover the working area.

What is claimed is:

1. Concrete distributing apparatus comprising a. a crane tower, b. a rotation track ring on the upper end of said tower, c. an upwardly extending mast on said track ring for rotation about a vertical axis, d. a joint having a horizontal axis on the lower end of said mast, e. a jib attached at its inner end to said joint, f. a mounting at the outer end of said jib, g. an upright support on said mounting for angular movements about a vertical axis, h. a pivotal joint having a horizontal axis on the upper end of said support, i. an articulated sectional pipe line for conveying concrete connected at one end to said pivotal joint, and j. power means for effecting pivotal movement of said pipe sections respectively.

2. Apparatus as claimed in claim 1, comprising a climbing device for raising said track ring thereby to elevate said jib and associated parts.

3. Apparatus as claimed in claim 1, comprising a second jib on the opposite side of said crane tower to counter-balance said first jib, said second jib being similar in structure and equipment as said first jib.

* * * * *